United States Patent [19]

Lewis et al.

[11] 3,984,651

[45] Oct. 5, 1976

[54] ELECTRICAL LOADBREAK ARC QUENCHING AND CONTAINING ASSEMBLY

[75] Inventors: Charles E. Lewis; Thayer A. Bonecutter, both of Zanesville, Ohio

[73] Assignee: McGraw-Edison Company, Elgin, Ill.

[22] Filed: May 1, 1975

[21] Appl. No.: 573,452

[52] U.S. Cl. ..... 200/144 C; 200/149 A; 200/151

[51] Int. Cl.[2] ..... H01H 33/04

[58] Field of Search..... 200/16 B, 16 E, 144 R, 200/144 A, 144 C, 149 R, 149 A, 151, 289, 163; 337/186, 278, 279, 280, 281; 317/15

[56] References Cited

UNITED STATES PATENTS

| | | | |
|---|---|---|---|
| 2,663,817 | 12/1953 | DeVal et al. | 200/144 R UX |
| 2,663,825 | 12/1953 | Amundson | 317/15 |
| 2,845,510 | 7/1958 | Biersack | 200/144 R |
| 3,542,986 | 11/1970 | Kotski | 200/149 A |
| 3,586,802 | 6/1971 | Nichols et al. | 200/151 X |
| 3,628,092 | 12/1971 | Keto | 337/186 X |
| 3,732,517 | 5/1973 | Keto et al. | 337/282 X |
| 3,792,215 | 2/1974 | Keto | 337/186 X |

*Primary Examiner*—James R. Scott
*Attorney, Agent, or Firm*—Jon Carl Gealow

[57] ABSTRACT

An electrical loadbreak device in which the arc established between two loadbreaking contacts is first confined to a narrow gap between the confronting surfaces of two insulating members formed of arc quenching material before reaching a larger volume space. Spiraled grooves are formed in one of the confronting surfaces to provide channels of increased length for the arc such that the arc voltage may be higher and to increase the exposure of the arc to the arc quenching material. The grooves further act to provide "spoiling" action to create turbulence in the hot gases. The hot gases emitting from the grooves impinge upon a baffle which is contoured to promote further turbulence and cooling of the hot gases.

10 Claims, 4 Drawing Figures

ELECTRICAL LOADBREAK ARC QUENCHING AND CONTAINING ASSEMBLY

BACKGROUND OF THE INVENTION

1. Field of the Invention

This invention relates to arc extinguishing means for use with loadbreak contacts of the type wherein a male contact probe is inserted in or withdrawn from a female probe receiving contact to make or break respectively a load current. Insulating members formed of arc extinguishing materials are positioned to surround, and in some cases block, the arc which may be established between the loadbreak contacts.

2. Description of the Prior Art

In the past various arrangements have been provided to surround, and in some cases block with insulating arc extinguishing materials, an arc established between loadbreak contacts. Some such arrangements have been disclosed for use with loadbreak fuseholders. For instance, in U.S. Pat. No. 3,628,092, issued Dec. 14, 1971, there is revealed an arrangement wherein a probe contact is provided with a cylindrical insulating tip, and a tubular insulating member surrounds, and is carried with a movable tubular contact. When the probe contact is withdrawn from the tubular contact the insulating tip follows the probe contact through a portion of the tubular insulating member which has an opening providing a close sliding fit with the insulating tip to confine, squeeze and extinguish the arc therebetween. However, due to the confining and squeezing of the arc, the hot gases making up the arc tend to "squirt" out of the confined volume at high velocities. The laminar flow of the hot gases in the confined volume contributes to the high velocities. Thus, problems are presented in further confining and cooling the gases after they exit the confined volume. U.S. Pat. No. 3,732,517, issued May 8, 1973, reveals an arc snuffing device wherein a spring loaded movable member or members close a deionizing chamber around one of the loadbreak contacts following separation of the loadbreak contacts. Thus, the arc is interrupted in and a major portion of the arc is confined within the deionizing chamber. However, the addition of the movable members, and the springs applying forces thereto, complicates the structure and increases the possibilities of the arc not being extinguished through failure of the movable members to operate to chokc off the arc.

Therefore, it is accordingly an object of this invention to provide an improved arc quenching arrangement for use with loadbreak contacts of the type wherein a contact probe is inserted in or withdrawn from a probe receiving contact to make or break a load current carrying circuit. It is a further object of this invention to provide improved arc quenching with a minimum number of components in a device which is readily assembled and is reliable in operation.

SUMMARY OF THE INVENTION

The foregoing objects are accomplished in accordance with the invention, in one form thereof, by providing a loadbreak device having probe and probe receiving contacts, with an arc quenching and containing assembly of novel construction.

The loadbreak contacts are contained within an insulating tube in both their engaged and disengaged positions. The probe receiving contact is surrounded by a first portion of an insulating sleeve which is supported within the insulating tube and spaced from the inner surface of the tube and from the probe receiving contact. A second portion of the insulating sleeve extends beyond the probe receiving end of the probe receiving contact and has a bore which conforms to the cross-section of, and is slightly larger than the cross-section of the probe contact. At least a portion of the outer surface of the sleeve is of enlarged cross-section so as to be closely spaced from the inner surface of the tube. The end of the sleeve opposite the probe contact receiving end is closed such that the sleeve serves to close the end of the tube to prevent the escape of gases therefrom.

The probe contact, along with an insulating assembly is supported for movement with the insulating tube relative to the probe receiving contact. An insulating tip member having a cross-section substantially the same as that of the probe contact is positioned on the leading end of the probe contact. The tip member enters the probe receiving contact before the probe contact on circuit making and follows the probe contact out of the probe receiving contact on circuit breaking. Another elongated insulating member having a cross-section substantially the same as that of the probe contact is positioned to extend from the trailing end of the probe contact. An insulating barrier, which is also a part of the insulating assembly, is positioned on the trailing end of, and is spaced apart from the probe contact. The barrier has a cross-section such that its perimeter which is closely spaced from the inner surface of the tube. A conductive member extends through the elongated insulating member and the insulating barrier to provide a trailing electrical connection to the probe contact.

The bore of the second portion of the insulating sleeve is of reduced cross-section and conforms to the shape of and is slightly larger than the cross-section of the probe contact. At least one groove is provided in the wall of the insulating sleeve forming the bore so as to provide at least one channel for the flow of the arc gases generated upon circuit making or breaking. The groove increases the insulating surface exposed to the arc gases so as to provide further cooling of the gases. The groove or grooves are formed to promote turbulence in the gas, thereby breaking up the laminar flow which might otherwise exist between the outer surface of the insulating tip member and the wall of the insulating sleeve forming the bore. For instance, the groove or grooves may be spiraled so as to increase the length of the groove and thereby permit higher arc voltages and to provide more contact with the insulating surface for greater cooling of the arc gases.

Gases generated by an arc established between the loadbreak contacts are first confined within the sleeve, and then pass out of the bore of the second portion of the insulating sleeve around the surface of the insulating tip through the groove or grooves. The gases are thereafter confined to a larger volume defined by the barrier, and the portion of the outer surface of the sleeve which is of enlarged cross-sectional area, and the portion of the inner surface of the tube which is therebetween. Further, turbulence of the gases in the larger volume may be promoted by providing the insulating assembly with an insulating baffle member positioned between the barrier and the probe contact. The surface of the baffle facing the probe contact is contoured to promote turbulence of the gases impinging thereon.

BRIEF DESCRIPTION OF THE DRAWINGS

The subject matter which we regard as our invention is particularly pointed out and distinctly claimed in the concluding portion of the specification. The invention itself, however, together with further objects and advantages thereof, may be best understood by making reference to the following description taken in conjunction with the accompanying drawings in which:

DESCRIPTION OF THE PREFERRED EMBODIMENT

Figure 1:
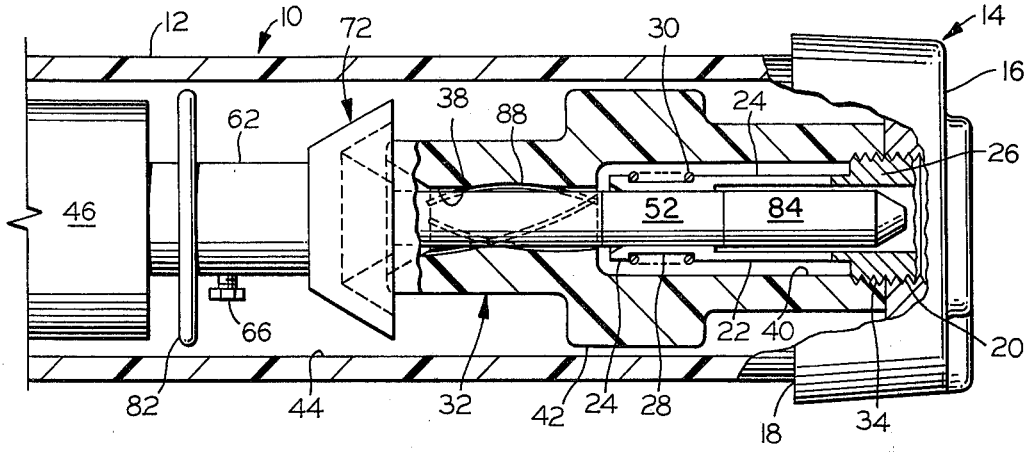
FIG. 1 is a side elevation view, partially in cross-section, showing a loadbreak device provided with an arc quenching and containing assembly constructed in accordance with the preferred embodiment of this invention.

Referring to the drawings, a loadbreak device provided with an arc quenching and containing assembly in accordance with the preferred embodiment of this invention is shown. While the arc quenching and containing assembly of this invention is intended to have many uses, it is shown in the drawing and will be described as included in a loadbreak fuse and canister assembly 10. The canister is in part formed of a cylindrical tube 12, a portion of which is shown. In the preferred embodiment tube 12 is a filament wound, oil-proof, glass-filled epoxy tube, the outer periphery of which has a resin rich surface. Secured to one end of the tube 12 is a closure and loadbreak contact assembly 14. In the preferred embodiment of this invention a hub 16 is formed as a cast aluminum member which is internally threaded (threads not shown) to receive the threaded end 18 of the tube 12 (threads not shown). A threaded bore 20 is provided on the inner surface of hub 16 for threadedly receiving and supporting a loadbreak contact 22. The loadbreak contact 22 is a tulip type contact having a plurality of fingers 24 extending from a cylindrical externally threaded base 26. This contact may, for instance, be machined from a hard tempered copper rod. The fingers 24 are provided with grooves 28 near their free end for receiving a coil spring 30 which exerts an inward force on the fingers. Threaded base 26 of the contact 22 is received in the threaded bore 20 in the hub 16.

Figure 4:
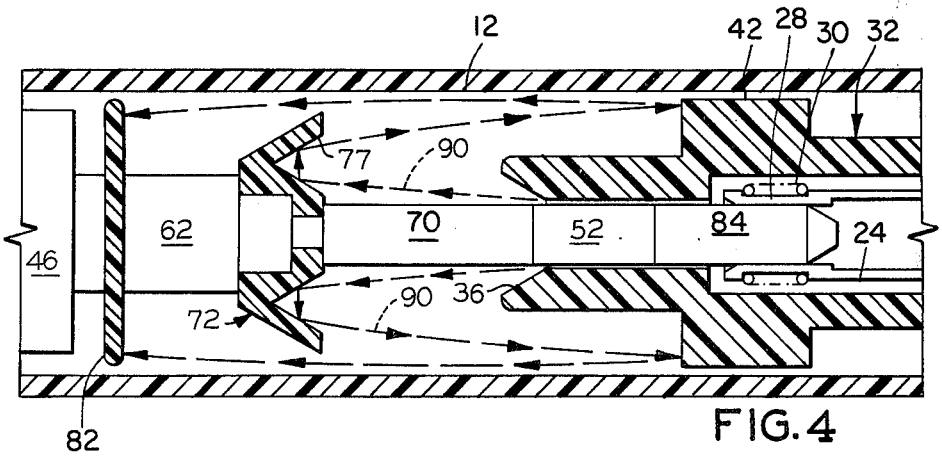
FIG. 4 is a reduced elevation view of the loadbreak device shown in FIG. 1, with the contacts shown in the position just prior to engagement or just after engagement.

An insulating sleeve 32 having a step internal diameter is provided with internal threads 34 at one end for engagement with the threaded base 26 of the loadbreak contact 22. The free end or inner end of the sleeve 32 is provided with a conical opening 36, the smaller end of which opens into a bore of reduced cross-section 38 in sleeve 32. The portion of the sleeve 32 surrounding the fingers 24 of the contact 22 has a bore of enlarged cross-section 40. The outer wall of the sleeve 32 is provided intermediate its length with a portion 42 of enlarged cross-section. The perimeter of this enlarged portion substantially conforms to the shape of the inner surface 44 of the tube 12, being spaced apart only sufficiently to provide clearance for assembly. For purposes of illustration this spacing is exaggerated in FIGS. 1 and 4.

Figure 2:
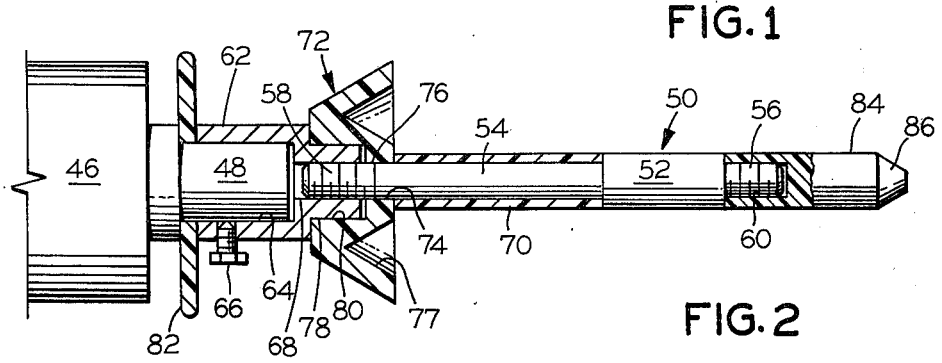
FIG. 2 is a side elevation view, partially in cross-section, of the probe contact and insulating assembly shown in FIG. 1.
Figure 3:
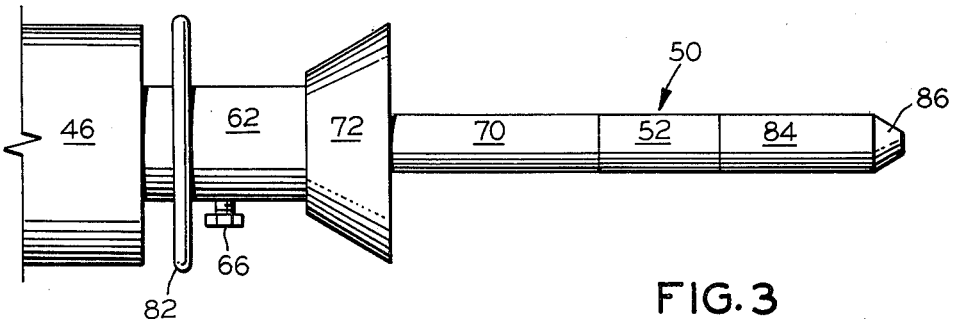
FIG. 3 is a slide elevation view, of the probe contact and insulating assembly shown in FIGS. 1 and 2.

Having thus described the loadbreak contact portion of the canister assembly, the fuse and movable contact assembly that is received therein will now be described. A load limiting fuse 46 (only a portion of which is shown) is provided with a mounting stud 48, shown in FIG. 2 which also serves as one of the electrical connections to the fusible element of the fuse 46. Secured to the mounting stud 48 is a movable loadbreak contact 50 which mates with the fixed loadbreak contact 22. Movable loadbreak contact 50 includes a cylindrical contact engaging portion 52 which is formed from a conductive material such as brass. The conductive portion of the movable loadbreak contact 50, which includes contact engaging portion 52, may be formed as a machine part, with cylindrical portions of reduced diameter 54 and 56 extending from each end of contact engaging portion 52. Threaded portions 58 and 60 are provided on the free ends of reduced diameter portion 54 and 56 respectively. A conductive coupling member 62 is provided with a stepped bore having an enlarged diameter portion 64 sized to receive the fuse mounting stud 48. A set screw 66 is provided to secure the conductive coupling member 62 to mounting stud 48. A reduced diameter portion 68 of the base of conductive coupling member 62 is threaded to receive the threaded portion 58 of contact 50.

A sleeve 70 formed of an arc suppressant insulating material having the same external diameter as the cylindrical contact engaging portion 52 is placed over the reduced diameter portion 54 in an axial abutting a relationship with the edge of the contact engaging portion 52. A cup-shaped baffle 72 which may be formed of the same arc suppressant insulating material as the sleeve 70 is provided with a central bore 74, one portion of which 76 is sized to receive the reduced diameter portion 54 of the contact. The cup-shaped baffle 72 is provided with a V-shaped groove 77 facing toward the fixed contact. The portion 78 of the of the coupling member 62 surrounding the reduced diameter portion 68 of the bore is of reduced diameter and is designed to be received in an enlarged diameter portion 80 of the bore in baffle 72. When the conductive coupling member 62 is threadedly engaged with the threaded portion 58 of the contact 50, the insulating sleeve 70 and the cup-shaped baffle 72 are secured in place. A barrier 82 is captured between a shoulder on the fuse 46 and the end of the coupling member 62. The barrier 82 has a cross-section such that its perimeter is closely spaced from the inner surface 44 of the tube 12.

An insulating contact tip 84 is provided with a threaded bore which receives the threaded portion 60 of the reduced diameter portion 56 of the contact 50. The tip 84 may be formed of an insulating arc suppressing material and is of the same external diameter of the cylindrical contact engaging portion 52. The lip 84 is provided at its free end with a conical tip 86 for engaging the fingers 24 of the contact 22.

The bore of reduced cross-section 38 of the sleeve 32 is provided with helical grooves 88 which provide channels for the flow of arc gases generated upon circuit making or breaking between the bore of reduced cross-section 38 of the sleeve 32 and the contact engaging portion 52 and insulating contact tip 84. Under certain conditions of heavy current flow, wherein a larger arc is established, it has been found desirable to impede the flow, that is to decrease the velocity of the flow of the hot gases through the restricted area formed in part by the bore 38. This is accomplished by the helical grooves 88. The flow of the hot gases over and through the grooves 88 imparts a rotational motion to the hot gases, thereby increasing the effective length of flow of the arc and/or gases for the same axial length of the bore 38 of the sleeve 32. As a result, higher arc voltages can be supported and more contact is provided with the arc suppressant insulating material. The helical grooves 88 also provide some "spoiling" action to break up the laminar flow of the arc gases which would otherwise occur within the bore 38. This increased turbulence provides improved cooling and reduces the velocity of the gases expelled from the fuse end of the sleeve. It is desirable that the grooves be deep enough to yield maximum influence on the flow of the ionized gases, but not so deep as to create a degrading influence due to too much of an increase in the arc cross-section. It has been found that the per unit increase in cross-section in the clearance area within the bore 38 by the addition of the grooves should be less than the per unit increase in the effective arc length created thereby.

The arc quenching tip 84 is effective on closing of the contacts to cool a "pre-strike" arc wherein it is directly in contact with the arc. It also helps to cool the arc of a loadbreak operation by choking off and cooling the hot gases that escape between the tip and the bore 38 in the sleeve. Within the bore 38, the same choking and cooling results are obtained during a loadmake operations as during loadbreak operations.

The V-shaped groove 77 in the baffle 72 creates a turbulence within the tube 12 when the gases are thrust into the cup against the inner surface of the groove, and as a result of the angle of incident, rebound outward against the outer surface of the V-shaped groove setting up a random flow pattern which slows and cools the gases. A random flow of gases is confined to the volume defined by the inner surface 44 of the tube 12, the barrier 82 and the enlarged cross-section portion 42 of the insulating sleeve 32. The dashed line 90 with arrowheads indicate a possible direct course of flow of the arc gases. However, as previously set forth, while a stream of gas might take the indicated path, a random flow pattern is quickly set up which leads to the rapid cooling of the gases as they rebound off of the various insulating arc extinguishing materials forming the confined area.

A further feature of the invention is that wherein the arcs on making or breaking of the contacts tend to form in the grooves, erosion of the cylindrical contact engaging portion 52 of the movable contact 50 is moved around the surface as it is inserted in the female load break contact 22 with random angular relationships. That is, the loadbreak contact 22 and 52 are not engaged with a predetermined angular relationship, but are engaged in a random angular relationship.

In a typical loadbreak device of the type shown wherein the diameter of the cylindrical contact engaging portion 52 of the movable contact 50 is ⅝ of an inch in diameter, the spacing between the outer perimeter of the barrier 82 and the outer enlarged cross-section 42 of the sleeve 32 would be approximately 1/16 inch, while the spacing between the outer perimeter of the cup-shaped baffle 72 and the inner surface 44 of the tube 12 would be ⅛ inch. In the same application three grooves would be provided equally spaced around the circumference of the bore of reduced cross-section 38 with a triangular cross-section 90 thousands of an inch wide at the top and 45 thousands of an inch deep. The spacing between the cylindrical contact engaging portion 52 and the bore of reduced cross-section 38 in the same application would be about 10 thousands of an inch. Finally, in the same application, the three grooves which are equally spaced around the bore traverse a 60° included angle.

While the invention has been shown as employed in a loadbreak fuse and canister assembly, it might be equally well applied in other applications utilizing loadbreak contacts of the same general type.

It should be apparent to those skilled in the art, that while what has been described are considered at the present to be the preferred embodiments of this invention, in accordance with the patent statutes, changes may be made in the disclosed method of making an arc extinguishing chamber without actually departing from the true spirit and scope of this invention.

What is claimed as new and is desired to be secured by Letters Patent of the United States is:

1. In a loadbreak device having a male probe loadbreak contact and a female probe receiving loadbreak contact operative to make in an engaged position or break in a disengaged position a circuit upon insertion or withdrawal respectively of the probe contact into or from within the probe receiving contact, an arc quenching and containing assembly comprising:

A. an insulating tube enclosing the loadbreak contacts in both their engaged and disengaged positions;

B. an insulating sleeve having first and second portions supported within said tube in a fixed relationship with respect to the probe receiving contact, said first portion of said sleeve surrounding and spaced from the probe receiving contact, and spaced from the inner surface of said tube, said second portion of said sleeve extending beyond the probe receiving end of the probe receiving contact, and having a bore which is of reduced cross-section compared to said first portion and which conforms in shape to and is slightly larger than the cross-section of the probe contact so as to provide slight clearance therebetween when said probe contact is positioned therein, the outer surface of said sleeve, intermediate its length, being provided with a portion of enlarged cross-section so as to be closely spaced from the inner surface of said tube, and the end of said insulating sleeve opposite said probe receiving end being closed to prevent the escape of gases therefrom;

C. an insulating assembly supported in a fixed relationship with respect to said probe contact including:

1. an insulating tip member having a cross-section substantially the same as that of the probe contact and positioned on the leading end of the probe contact to enter the probe receiving contact before the probe contact upon circuit making.
2. a first insulating member having a cross-section substantially the same as that of the probe contact and extending from the trailing end of the probe contact,
3. an insulating barrier positioned on the trailing side of and spaced apart from said probe contact having a cross-section such that its perimeter is closely spaced from the inner surface of said tube, 4. a conductive member extending through said first insulating member and said insulating barrier to provide a trailing electrical connection to the probe contact; and D. said bore of reduced cross-section of said insulating sleeve having at least one groove formed therein to provide at least one channel for the flow of arc gases generated upon circuit making or breaking so as to provide further cooling of the gases by increased insulating surface exposure to the arc gases, and which at least groove is formed to promote turbulence in the gas by breaking up the laminar flow which would otherwise exist between the outer surface of said insulating tip member and the inner surface of the bore of reduced cross-section;

whereby gases generated by an arc established between said loadbreak contacts are first confined within said sleeve and then pass out of said bore of reduced cross-section around said insulating tip member through said at least one groove, and are thereafter substantially confined to the volume defined by said insulating barrier, said sleeve portion of enlarged cross-section and the inner surface of said tube therebetween, the gases being further cooled by impingement with said confining members such that said arc is extinguished without the escape of gases from said confined volume during making or breaking of the loadbreak contacts.

2. The arc quenching and containing assembly set forth in claim 1 wherein said at least one groove is spiraled so as to increase the length of said groove and thereby permit a higher arc voltage and to provide more contact with the insulating surface for greater cooling.

3. The arc quenching and containing assembly set forth in claim 1 wherein said bore in said second portion of said sleeve is cylindrical and said at least one groove is helical.

4. The arc quenching and containing assembly set forth in claim 3 wherein three helical grooves are formed in said bore of said second portion of said sleeve and are angularly equally spaced around the circumference of said bore.

5. The arc quenching and containing assembly set forth in claim 4 wherein each of the helical grooves rotates 120° around the circumference of said bore in traversing from one end of said bore to the other.

6. The arc quenching and containing assembly set forth in claim 1 wherein said at least one groove is triangular in cross-section.

7. The arc quenching and containing assembly set forth in claim 1 wherein an insulating baffle member is positioned at the trailing end of said first insulating member, said baffle having a surface facing in the leading direction contoured to promote turbulence in the gases impinging thereon, the perimeter of said baffle being spaced from the inner surface of said tube so as to readily permit the flow of arc gases therebetween.

8. The arc quenching and containing assembly of claim 7 wherein said baffle surface facing in the leading direction is provided with an angular cup groove.

9. The arc quenching and containing assembly of claim 1, wherein said insulating sleeve, said insulating tip member, said first insulating member and said insulating barrier are formed of a material which in the presence of hot ionized gases of an arc will evolve gas to cool off the hot ionized gases and thereby extinguish the arc.

10. The arc quenching and containing assembly of claim 7, wherein said insulating baffle member is formed of a material which in the presence of hot ionized gases of an arc will evolve gas to cool off the hot ionized gases and thereby extinguish the arc.

* * * * *